US007004630B2

(12) United States Patent
Piechocki et al.

(10) Patent No.: US 7,004,630 B2
(45) Date of Patent: Feb. 28, 2006

(54) RECLOSABLE PACKAGING HAVING EXTENSIBLE OFFSET FUNNEL

(75) Inventors: Duane B. Piechocki, Pleasantville, NY (US); Steven Ausnit, New York, NY (US); Christian Schuchardt, New City, NY (US)

(73) Assignee: Illinois Tool Works Inc., Glenview, IL (US)

( * ) Notice: Subject to any disclaimer, the term of this patent is extended or adjusted under 35 U.S.C. 154(b) by 92 days.

(21) Appl. No.: 10/170,883

(22) Filed: Jun. 13, 2002

(65) Prior Publication Data

US 2003/0230595 A1 Dec. 18, 2003

(51) Int. Cl.
*B65D 33/00* (2006.01)

(52) U.S. Cl. ..... 383/36; 383/64; 383/5; 383/906

(58) Field of Classification Search ..... 383/63, 383/64, 61.1, 61.2, 906, 5, 36–38; 222/92
See application file for complete search history.

(56) References Cited

U.S. PATENT DOCUMENTS 3,471,871 A * 10/1969 Nociti et al. ..... 383/63
3,746,215 A 7/1973 Ausnit et al.
3,790,992 A * 2/1974 Herz ..... 383/64
3,991,801 A * 11/1976 Ausnit ..... 383/61.2
4,191,230 A * 3/1980 Ausnit ..... 383/61.2
4,196,030 A * 4/1980 Ausnit ..... 156/91
4,235,653 A * 11/1980 Ausnit ..... 156/91
4,651,504 A * 3/1987 Bentsen ..... 53/452
4,657,792 A * 4/1987 Ausnit ..... 383/63
5,354,132 A * 10/1994 Young et al. ..... 383/61.2
5,405,478 A * 4/1995 Richardson et al. ..... 156/308.4
5,442,837 A * 8/1995 Morgan ..... 24/400
5,779,894 A * 7/1998 Martensson ..... 383/38
6,527,444 B1 3/2003 Buchman

FOREIGN PATENT DOCUMENTS

JP 3-162247 * 7/1991 ..... 383/906

* cited by examiner

*Primary Examiner*—Robin A. Hylton
(74) *Attorney, Agent, or Firm*—Ostrager Chong Flaherty & Broitman P.C.

(57) ABSTRACT

A reclosable package has a flexible zipper and a flexible funnel that can be turned inside out to provide a spout for dispensing the package contents. The funnel has a terminal portion that is offset relative to a midplane of the package. Initially, the funnel is tucked inside the filled package in an unopened state. The funnel can be accessed by pulling apart the zipper halves. The consumer must reach inside the open package and pull the funnel inside out. Then the tip of the funnel is snipped, cut or torn to provide a spout for dispensing product. The offset of the opening allows the consumer to better direct the pour of the package contents, while making the bag easier to handle, especially large bags. The funnel itself directs the package contents, especially fine powders, away from the reclosable zipper profiles so that one or both profiles do not become clogged with matter that might interfere with interlocking.

5 Claims, 6 Drawing Sheets

RECLOSABLE PACKAGING HAVING EXTENSIBLE OFFSET FUNNEL

BACKGROUND OF THE INVENTION

This invention generally relates to reclosable pouches, bags or other packages having a flexible zipper. In particular, the invention relates to such a reclosable package having an internal funnel portion that is readily extensible outside of the package to act as a spout for controllably dispensing the contents of the package.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The present invention is not limited to reclosable packages with sliders, i.e., a slider is not required for practice of the invention. The profiles in plastic zippers can take on various configurations, e.g. interlocking rib and groove elements having so-called male and female profiles, interlocking alternating hook-shaped closure elements, etc.

Conventional slider-zipper assemblies typically comprise a plastic zipper having two interlocking profiles and a slider for opening and closing the zipper. In one type of slider-zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Another type of slider-zipper assembly avoids the use of a separating finger. For example, U.S. Pat. No. 6,047,450 discloses a zipper comprising a pair of mutually interlockable profiled structures. The first profiled structure comprises an interlocking element on a surface directed toward the second profiled structure and an integral base directed away from the second profiled structure. Likewise, the second profiled structure comprises an interlocking element on a surface directed toward the first profiled structure and an integral base directed away from the first profiled structure. Additionally, portions of the two profiled structures form a fulcrum about which the profiled structures may be pivoted out of engagement when lower edges of the bases are forced towards each other It is known to form a zippered reclosable package on a form, fill and seal apparatus. If the reclosable package is filled with a fine powder product, then the fine powder or particulate matter can clog one or both of the interlockable profiled elements, thereby degrading the performance of the zipper by blocking interlocking of the elements.

One known means for to prevent the contents of a package from interfering with the operation of the profiled zipper elements is to provide a funnel for channeling the contents past the zipper and out of the package. U.S. Pat. No. 3,746,215 discloses a flexible container having rib and groove elements wherein a funnel portion is provided interior to the container, which funnel portion may be extended outwardly of the container to act as a pouring spout. The funnel portion is normally positioned inwardly of the container, but can be reversed and turned inside out to extend outwardly of the container to cause its contents to bypass the rib and groove elements of the zipper. The funnel portion is attached to the inner walls of the container and, when in a flattened folded state, has the general shape of a triangle with a tip portion or apex that may be slit when the funnel portion is extended outwardly to act as a pouring spout. The funnel portion is so hinged to the walls of the container that it is easily reversible by the weight of the contents when the container is turned upside down.

There is a need for a funnel bag having an improved design to facilitate ease of use.

BRIEF DESCRIPTION OF THE INVENTION

The invention is directed to a reclosable package comprising a flexible zipper and a flexible funnel that can be turned inside out to provide a spout for dispensing the package contents. The funnel has a terminal portion that is offset relative to a midplane of the package. Initially, the funnel is tucked inside the filled package in an unopened state. The funnel can be accessed by pulling apart the zipper halves. The consumer must the reach inside the open package and pull the funnel out, thereby turning the funnel inside out. Then the tip of the funnel is snipped or cut or perforated for tearing to provide a spout for dispensing product. The offset of the opening allows the consumer to better direct the pour of the package contents, while making the bag easier to handle, especially large bags. The funnel itself directs the package contents, especially fine powders, away from the reclosable zipper profiles so that one or both profiles do not become clogged with matter that might interfere with the interlocking of zipper parts.

One aspect of the present invention is a package comprising: a receptacle having an interior volume and a mouth; a flexible zipper comprising first and second interlockable zipper parts that are interlocked to close said mouth and separated to open said mouth; and a flexible funnel portion projecting into said interior volume when in a retracted position and extending through said mouth and outside said receptacle when said flexible funnel portion is turned inside out, wherein said funnel portion comprises a terminal portion that is offset relative to a midplane of the package.

Another aspect of the invention is a package comprising: an outer bag having an interior volume and a mouth; a flexible zipper comprising first and second interlockable zipper parts that are interlocked to close said mouth and separated to open said mouth; and an inner bag residing in said interior volume when in a retracted position and extending through said mouth and outside said outer bag when said inner bag is turned inside out, wherein said inner bag narrows toward a terminal portion that is offset relative to a midplane of said package.

A further aspect of the invention is a package comprising a receptacle having an interior volume and a mouth, the interior volume being at least partially filled with pourable material; a flexible zipper comprising first and second interlockable zipper parts that are interlocked to close the mouth and separated to open the mouth; and a flexible funnel portion disposed between the zipper and the pourable material when the zipper is closed, and forming a spout outside of the interior volume when the zipper is open and the package is turned upside down. The funnel portion is sufficiently flexible that the funnel portion is pushed inside out by the weight of the pourable material when the package is turned upside down. The funnel portion comprises a terminal portion that is offset relative to a midplane of the package when the funnel portion is turned inside out.

Yet another aspect of the invention is a package comprising an inner bag and an outer bag that are joined along a periphery, and further comprising a flexible zipper disposed in a mouth of said the bag, the mouth being located above the periphery. The inner bag is transformable between first and second states, and comprises a funnel portion that projects inside the outer bag in the first state and extends through the mouth and projects partly outside of the package in the second state. The funnel portion comprises a terminal portion that is offset relative to a midplane of the package when the inner bag is in the first and second states.

When the funnel is made of the same material as the outer bag, the funnel also provides a hermetic seal that prevents any air getting through the zipper and spoiling the contents of the outer bag.

Other aspects of the invention are disclosed and claimed below.

DETAILED DESCRIPTION OF THE INVENTION

Figure 1:
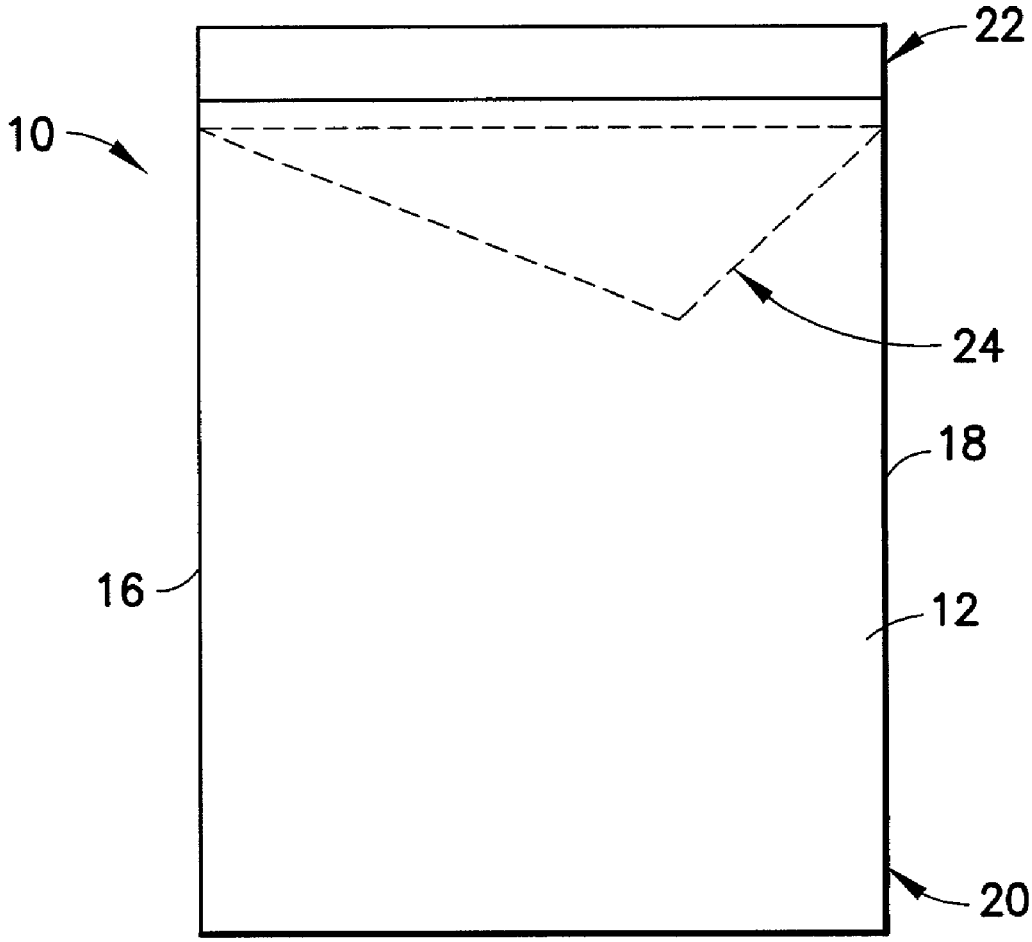
FIG. 1 is a schematic showing an elevational view of a zippered package having an inner bag with an unopened offset funnel portion in accordance with one embodiment of the invention. The funnel portion is shown in a retracted position on the product side of the zipper.

The present invention relates to packages designed to hold pourable material, such as liquid or granular solid. Such packages may take the form of pouches or bags. Reclosable fastener assemblies are useful for sealing such bags. Such fastener assemblies often include a plastic zipper with or without a slider. Typically, the plastic zippers include a pair of interlockable profiled fastener elements that form a closure. In zippered bags with sliders, as the slider moves across the zipper, the zipper is opened or closed. The zipper profiles may take any form. For example, the zipper may comprise interlocking rib and groove elements or alternating hook-shaped closure elements. The profiles may be extruded separately and attached to the respective sides of the bag or the profiles may be extruded integrally with the sides of the bag.

The slider for opening or closing the reclosable zipper is generally shaped so that the slider straddles the zipper profiles. The sliders often include a separating element that is inserted between the profiles in order to open the zipper. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene tereph-thalate, high-density polyethylene, polycarbonate, or ABS.

A bag incorporating a zipper and a slider preferably includes means, such as end stops, for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The walls of the package may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

The interlocking rib and groove elements are well known in the art and many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements.

Normally, pull flanges are provided outwardly of the package adjacent to the rib and groove elements to enable the user to grip the flanges and forcibly pull the rib and groove elements apart. These flanges may be provided so that one is longer than the other for easy access to the user or, for instance, one of the flanges may have a raised bead formed therealong to make the flanges more easily separable so that a person using the container can easily grip the flanges and pull apart the interlocking rib and groove elements. The interlocking elements are then resealable simply by pressing the zipper elements together from the outside of the package. The elements are carefully aligned at the inside of the package wall and simply by sliding the fingers along the outside of the package the elements are readily reclosable.

The rib and groove elements may be carefully formed of a soft flexible material in part thereof so that the contents of the package are in fact relatively hermetically sealed from the outside.

It is common to use such flexible packages to hold a variety of substances, such as fine powders or the like. It has been discovered, however, that in removing only a portion of such powders from the package, the resealability of the package may be impeded by the presence of small granules of material in between the rib and groove elements. The rib and groove elements can be relatively small elements and it is important that granules of material from the contents of the package do not become trapped in the groove, for any such granules of material could easily prevent the rib from being pressed sufficiently deeply into the groove to become interlocked.

The present invention provides a means for allowing the contents of such a zippered package to be readily removed from the package and to do so in such a way as to bypass the zipper elements. This is accomplished generally by providing a bag-within-a-bag type of arrangement wherein an inner bag is connected to the inner walls of an outer bag at an elevation below the interlockable profiled zipper elements. The contents of the package are contained in the volume between the inner and outer bags.

In one embodiment of the invention, the inner bag comprises a funnel portion that can be opened at its distal end or apex. The funnel portion may have the shape of a scalene triangle (i.e., a triangle with sides of unequal length) so that one vertex of the triangle (namely, the apex of the funnel) is offset from the midplane of the package. When the apex is snipped with a pair of scissors or merely tom, the contents may be controllably dispensed from the package by using the funnel portion of the inner bag as a spout. As used herein, the phrase "offset relative to a midplane of the package" means that the funnel opening is disposed closer to one side edge of the package than the other side edge, not in the middle of the package. Alternatively, the funnel portion may be a trapezoid with unequal sides (i.e., a truncated scalene triangle). However, other geometric shapes can be used so long as the geometry provides an offset nadir or low point where the spout orifice will be formed.

In one embodiment, the inner bag is made of the same type of flexible material as the outer bag and is secured to the inner surface of the walls of the outer bag just below or inwardly of the rib and groove elements. Therefore, when the rib and groove elements are closed, the inner bag is directed inwardly of the outer bag and serves as a hermetic seal. However, when it is desired to remove the contents of the package, the zipper is opened and the funnel portion of the inner bag is merely inverted or turned inside out. The weight of the contents will force the funnel portion to extend outwardly of the package, past the rib and groove elements. In this way the contents of the package fall into the inverted funnel portion, never touching the rib and groove elements. Alternatively, the inner and outer bags can be made of different materials.

Because the open apex of the funnel portion is offset, the user is better able to direct the poured material to its target. The offset spout also makes the bag, especially a large bag, easier to handle during pouring. In its unopened state, the funnel gives extra protection to the contents of the bag in the event of accidental opening of the zipper and provides evidence of tampering.

The inner bag may be heat sealed or fused to the inner walls of the package and preferably in such a fashion so that the funnel may be easily turned inside out to extend outwardly of the package. On the one hand, if the zipper profiles are extruded onto the outer bag walls, then the inner bag is heat sealed or fused to the walls of the outer bag. On the other hand, if the zipper is extruded, cooled and then applied to the outer bag, then each zipper element preferably comprises a profiled interlockable element and an extension flange. In the latter case, the walls of the outer bag can be heat sealed or fused to the outer surfaces of the extension flanges, while the walls of the inner bag are heat sealed or fused to the inner surfaces of the extension flanges.

After a desired quantity of material is dispensed from the package, the funnel portion is merely pushed and tucked back into the interior of the outer bag, resuming its uninverted configuration, and then the rib and groove elements of the zipper are closed in the normal manner. The powder or other contents that filled the funnel when the latter was turned inside out is then returned to the interior volume of the receptacle. Because the powder or other material in the package has not come into contact with the rib and groove elements, a completely reliable resealing of the rib and groove elements is made possible.

Figure 2:
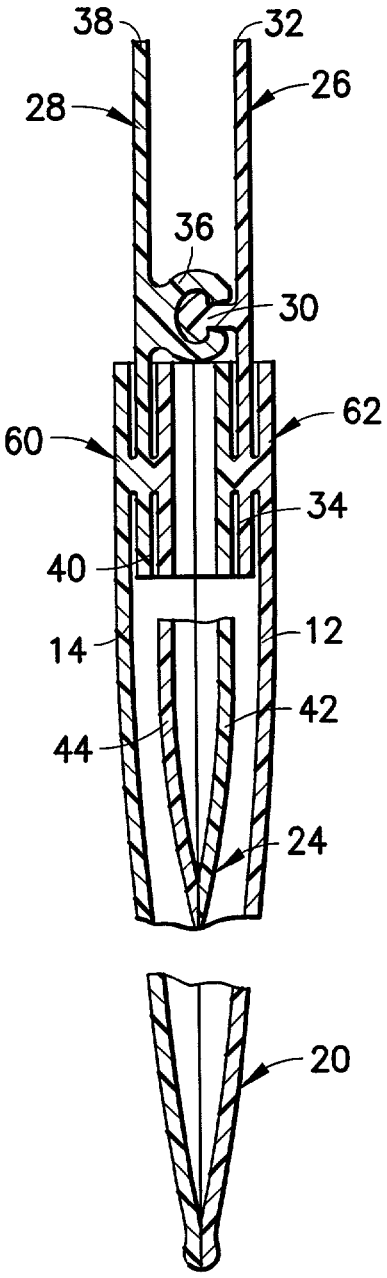
FIG. 2 is a schematic showing a sectional view of part of the zippered package depicted in FIG. 1.

One embodiment of the invention is depicted in the drawings. FIGS. 1 and 2 show a package 10 comprising front and rear walls 12 and 14 formed by a sheet of flexible thermoplastic material that has been folded at the bottom of the package. The walls or panels 12 and 14 are heat sealed at side edges 16 and 18 to define an outer bag 20 having an interior volume for receiving the contents (not shown) of the package. The package 10 further comprises a plastic zipper 22 installed in the mouth of the package and an inner bag 24 having a funnel shape.

As best seen in FIG. 2, the zipper comprises a pair of fastener strips 26 and 28. The fastener strip 26 comprises a ribbed element 30, a pull flange 32 and an extension flange 34, while the fastener strip 28 comprises a grooved element 36, a pull flange 38 and an extension flange 40. The profile of the ribbed element 30 is designed to enter and interlock with the profile of the grooved element 36, as seen in FIG. 2, thereby closing the zipper and closing the mouth of the package. However, zipper elements having other profiles, e.g. alternating hook-shaped closure elements, can be used. The pull flanges 32 and 38 at the upper portion of the package can be gripped by the user to pull the zipper elements apart, thereby allowing a user access to the inner bag 24 tucked inside the outer bag.

Figure 3:
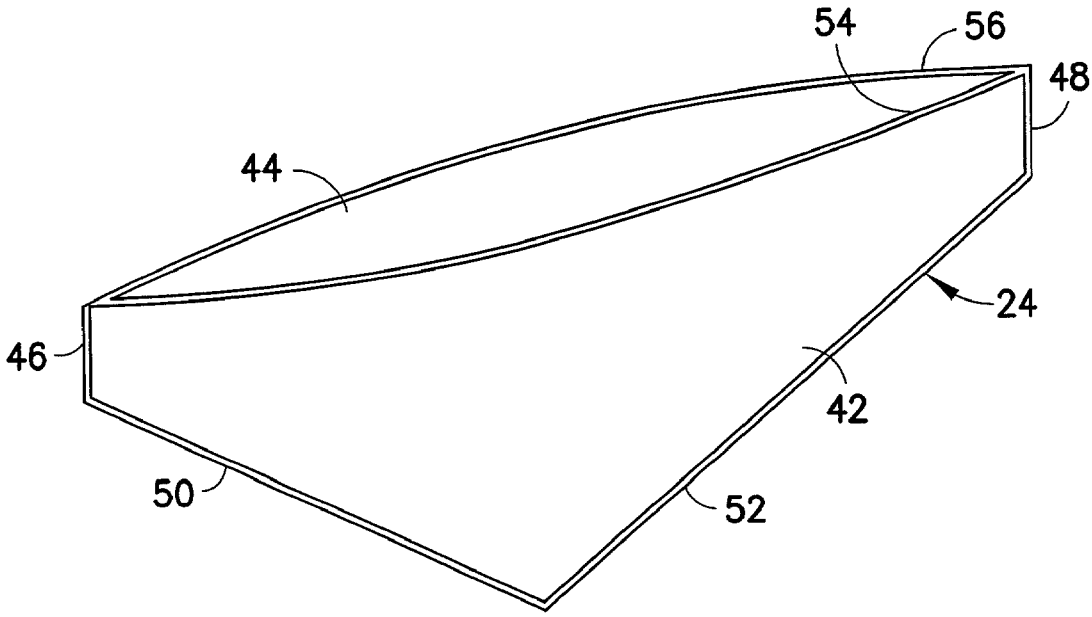
FIG. 3 is a schematic showing an isometric view of an inner bag as it would appear prior to being inserted into the outer bag.

The inner bag 24 is shown more clearly in FIG. 3. The inner bag 24 comprises a pair of walls 42 and 44, each wall being in the shape of a five-sided polygon. Walls 42 and 44 are heat sealed along side edges 46 and 48 to the sides of the outer bag (and to each other), and are heat sealed along diagonal edges 50 and 52 to each other but not to the outer bag walls. Preferably, side edges 46 and 48 are mutually parallel. Walls 42 and 44 respectively have top edges 54 and 56 that are preferably perpendicular to the parallel side edges 46 and 48.

Figure 4:
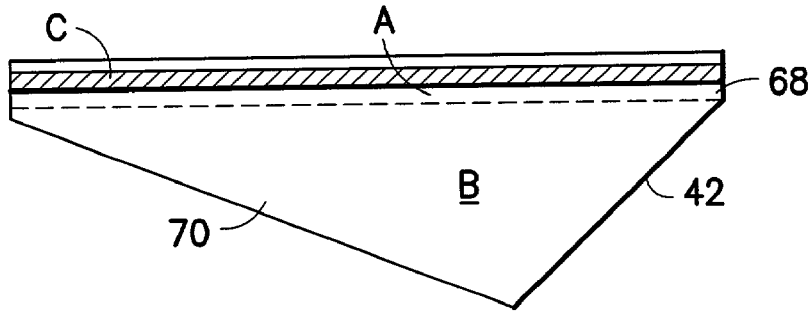
FIG. 4 is a schematic showing the geometry of the inner structure having a funnel portion.

As shown in FIG. 4, wall 42 of the inner bag comprises a rectangular area A and a triangular area B separated by the dashed line. Preferably wall 44 has the identical shape and size. The areas A of walls 42 and 44 form a base portion 68 of the inner bag 24, while the areas B of walls 42 and 44 form a funnel portion 70 of the inner bag 24. Portions of the rectangular areas A of walls 42 and 44, e.g., transverse strip-like areas C, are heat sealed or otherwise joined to either the respective extension flanges or the respective outer bag walls.

The height of the rectangular area A needs to be equal to or greater than the height of the joining zones C. The joining zones C preferably run continuously from one side edge 16 to the other side edge 18 of outer bag 20, forming a continuous closed perimeter joining the inner bag to the outer bag. Thus the inner bag, prior to snipping off of the funnel apex, forms a tamper-evident membrane that blocks access to the package contents when the zipper is open.

As seen in FIG. 2, the outer bag wall 12 is joined to the outer surface of extension flange 34 of the ribbed element 30 while inner bag wall 42 is joined to the inner surface of extension flange 34, whereas outer bag wall 14 is joined to the outer surface of extension flange 40 of the grooved element 36 while inner bag wall 44 is joined to the inner surface of extension flange 40. Alternatively, the walls 12 and 14 of the outer bag could be respectively heat sealed or otherwise joined to the pull flanges 32 and 38 respectively, or the inner bag walls 42 and 44 could be joined directly to outer bag walls 12 and 14 respectively.

The person skilled in the art will readily appreciate that the attachment of the bags to extension flanges is not necessary to practice of the invention. The interlockable profiles of the zipper could instead be extruded directly onto the outer bag film and then the inner bag could be joined to the outer bag.

Figure 6:
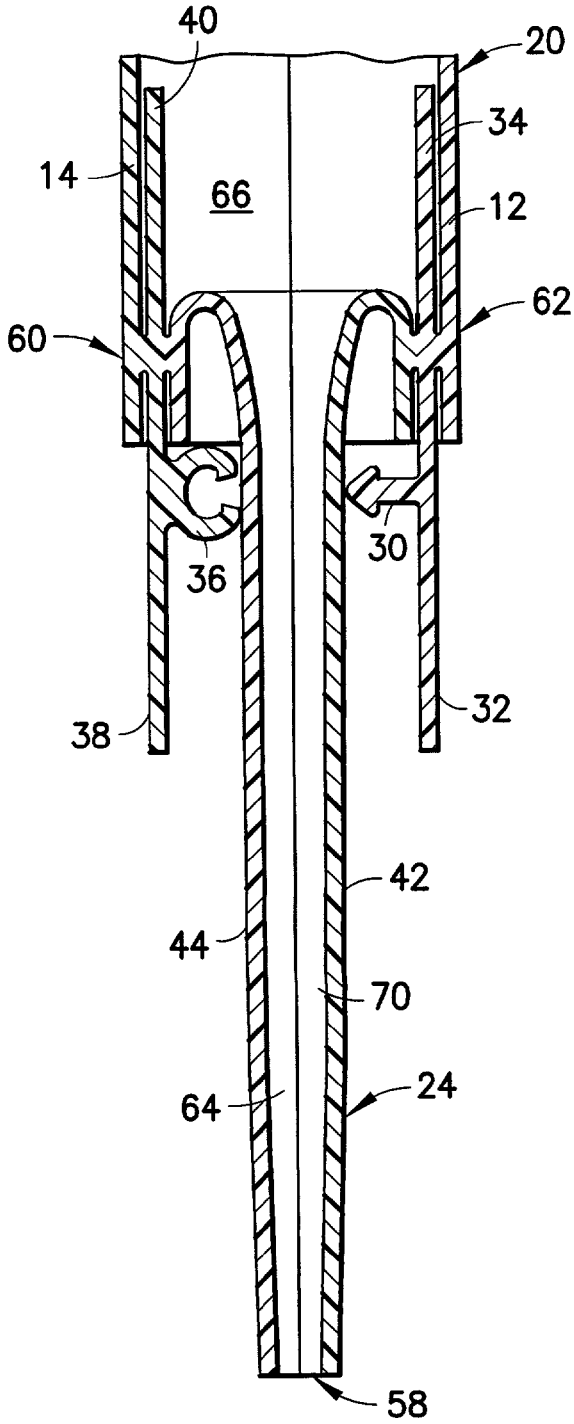
FIG. 6 is a schematic showing a sectional view of part of the zippered package depicted in FIG. 5.
Figure 5:
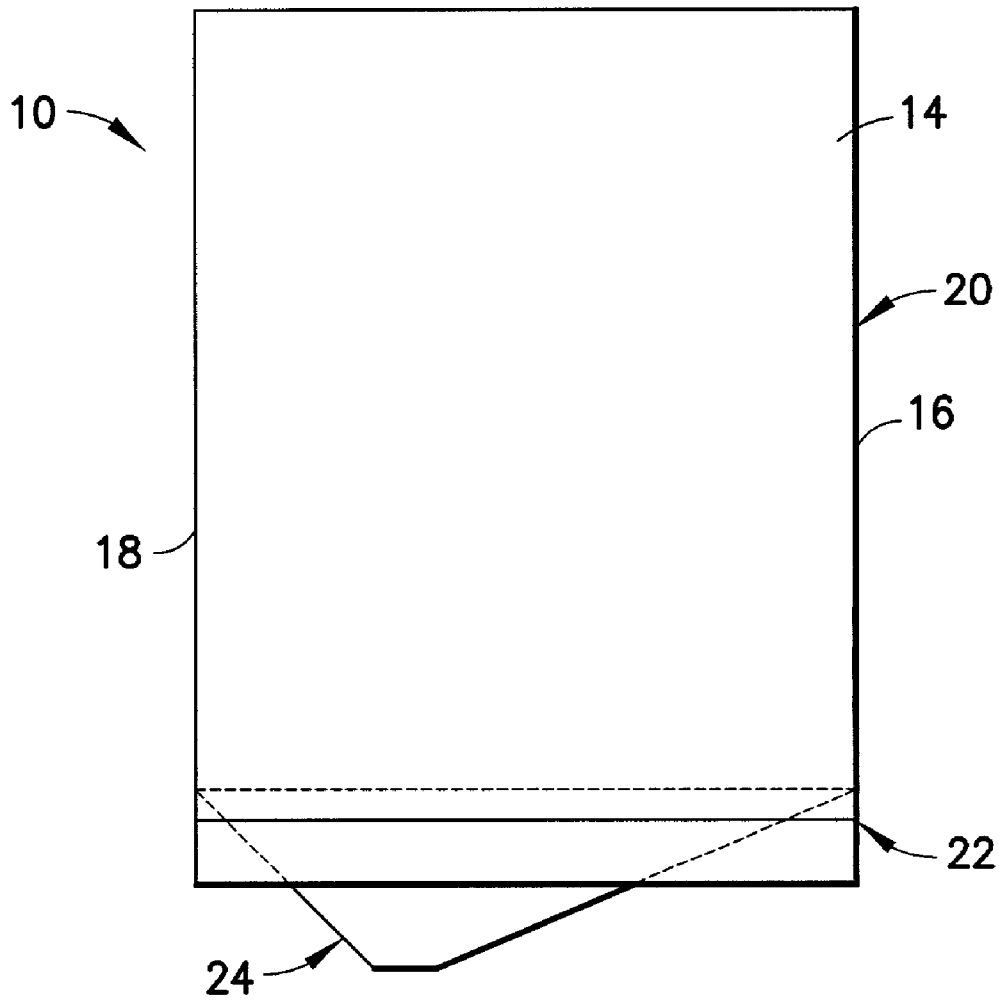
FIG. 5 is a schematic showing an elevational view of a zippered package having an inner bag with an offset funnel portion with an opening in a terminal portion. The funnel portion is shown in a fully extended position.

In FIG. 2 the funnel portion is shown projecting inwardly of the outer bag 20, and the interlocking rib and groove elements 30 and 36 are shown in the locked position. When the funnel is made of the same material as the outer bag, the funnel provides a hermetic seal that prevents any air getting through the zipper and into the interior volume of the outer bag. In FIG. 5 the package 10 is shown in the upside-down position with the apex of the funnel portion extending outwardly of the zipper 22. FIG. 6 shows an enlarged view of a section of the package of FIG. 5, showing the passageway 64 that is provided within the funnel portion 70 and that may carry contents from the interior 66 of the outer bag 20 directly to the opening 58 of the snipped spout. Also, the shielding effect of the walls 42 and 44 of the funnel portion 70 is illustrated.

In FIG. 6 the funnel portion of the inner bag is shown turned inside out and with a terminal portion or tip removed, e.g., snipped, to form an opening 58. The junctions 60 and 62 in FIG. 6 represent the seal lines C (see FIG. 4) of the inner bag. Since these junctions are inward of the rib and groove elements of the zipper, as are the sealed funnel side edges 46 and 48, the walls 42 and 44 of the funnel portion 70 bypass the rib and groove elements, thereby, shielding those elements from the contents of the package as the contents are dispensed through the funnel.

When it is desired to reseal the package, the funnel portion 70 of the inner bag 24 is merely tucked back into the package and the rib and groove elements of the zipper 22 are sealed in the normal fashion.

By providing a device as shown, an improved resealability for flexible packages having rib and groove elements is accomplished. In addition, an improved means of pouring the contents from the package is also achieved. Also, additional security is provided for the package contents, up to the time it is first used, in the event of accidental opening of the zipper.

Figure 7:
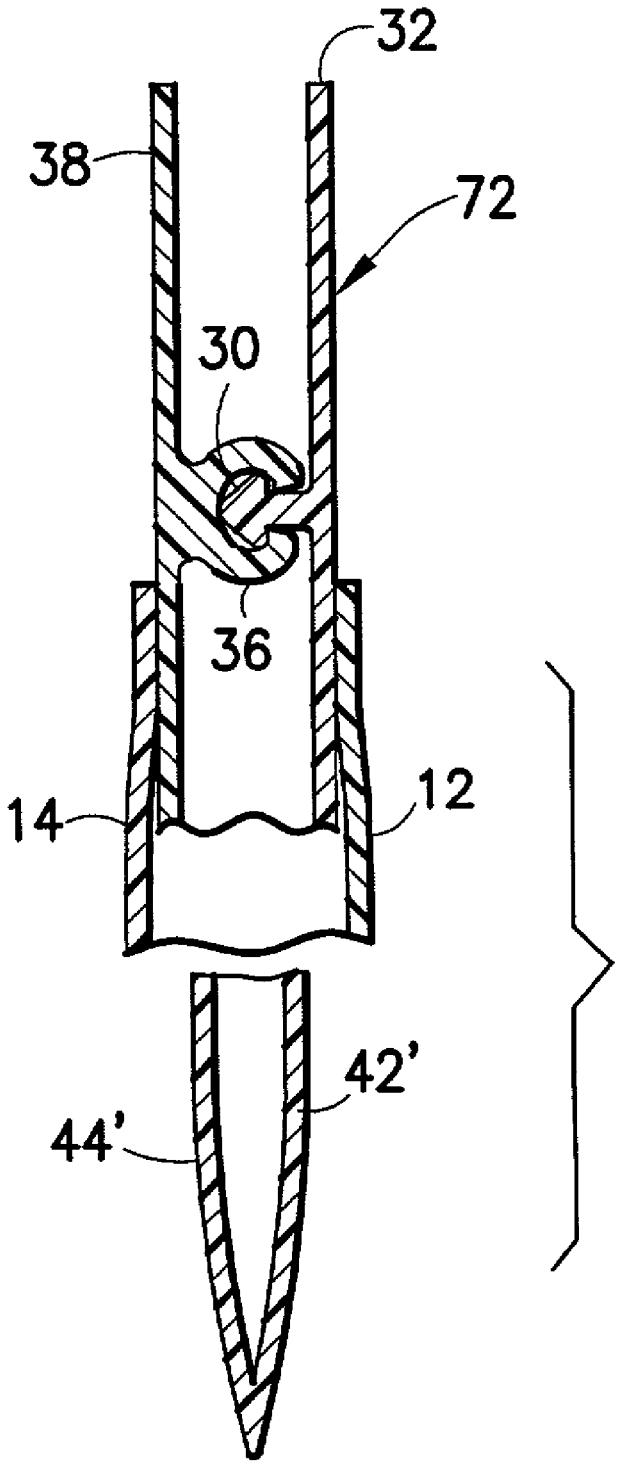
FIG. 7 is a schematic showing a sectional view of part of a zippered package in accordance with another embodiment of the invention.
Figure 8:
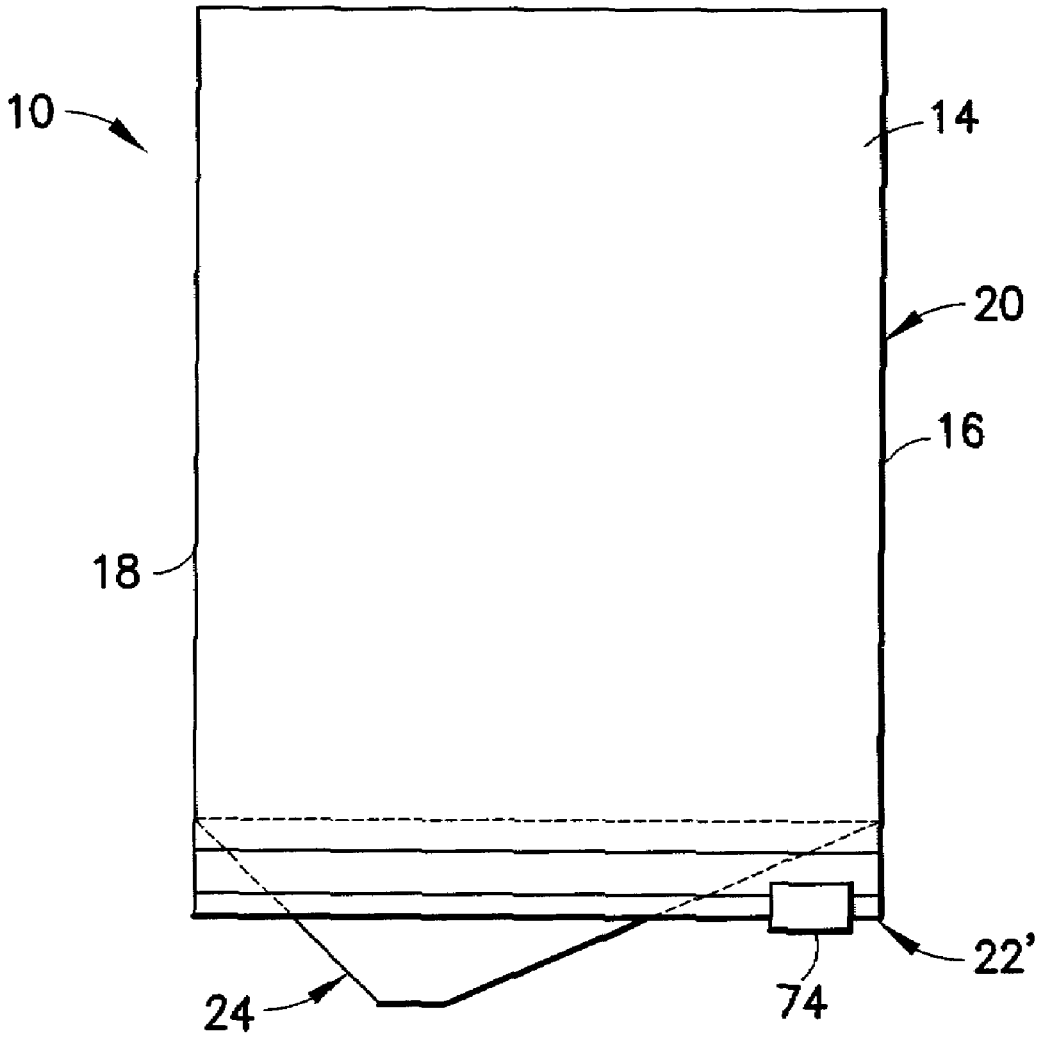
FIG. 8 is a schematic showing an elevational view of a package having a funnel bag and a slider operated zipper in accordance with a further embodiment of the invention.

In accordance with another embodiment of the invention, shown in FIG. 7, a zippered funnel bag 72 is formed by extruding the male and female zipper profiles 30 and 36 directly onto a web of film material, folding the web of film material, interlocking the zipper profiles, and then heat sealing the film material in a zig-zag pattern to form a chain of precursor funnel bags. The precursor funnel bags are then placed between opposing walls of a second folded web of film material. The upper peripheral edge of one wall of the latter is heat sealed to one side of the precursor funnel bags. The other side of the second folded web is not yet sealed to the precursor funnel bags to facilitate filling. The resulting assembly of precursor funnel bags joined to one side of the second folded web is then cross sealed to form a series of connected packages, each package comprising an inner funnel bag inside an outer bag (formed by the second folded web). The outer bag of each package is then filled via the unsealed interstice between the inner and outer bags. After filling, the upper peripheral edge of the unsealed wall of the outer bag is heat sealed to the opposing side of the inner funnel bag. Then the packages are cut along the cross seals to form separate filled packages, each package comprising a zippered inner funnel bag, an outer bag and package contents located inside the outer bag and outside the inner bag. In FIG. 7, reference numerals 12 and 14 designate the walls of the outer bag, while reference numerals 42' and 44' designate the walls of the inner funnel bag.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the specification and claims, the terms "funnel" and "funnel portion" include structures that narrow as the tip is approached. The term "funnel" is not used herein in the sense of a precisely conical utensil, as might be understood by persons not skilled in the art of reclosable packaging. In addition, the terms "funnel" and "funnel portion" should be construed broadly to include structures that are open at a terminal portion and structures that are closed at a terminal portion. In the latter case, the closed terminal portion must eventually be opened in order to dispense the package contents via the funnel. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. A package comprising:

a receptacle having an interior volume and a mouth, said receptacle comprising first and second receptacle walls joined or connected along first, second and third sides with said mouth disposed along a fourth side connected to said first and second sides and opposing said third side;

a flexible zipper comprising first and second interlockable zipper parts that are interlocked to close said mouth and separated to open said mouth, said first zipper part comprising a first profiled closure element and a first extension flange connected to said first profiled closure element, and said second zipper part comprising a second profiled closure element and a second extension flange connected to said second profiled closure element, wherein said first receptacle wall is joined to said first extension flange along the full length of said mouth, and said second receptacle wall is joined to said second extension flange along the full length of said mouth;

a flexible funnel portion projecting into said interior volume of said receptacle when in a retracted position and extending through said mouth and outside said receptacle when said funnel portion is turned inside out, wherein said funnel portion comprises a terminus that is offset relative to a midplane of the package when said funnel portion is in said extended position, wherein said funnel portion comprises first and second funnel walls joined along first and second lines of joinder, said first funnel wall comprising a first base portion that is joined to said first extension flange along the full length of said mouth, and said second funnel wall comprising a second base portion that is joined to said second extension flange along the full length of said mouth; and a slider mounted to and cooperating with said zipper, said slider causing straddled portions of said first and second interlockable zipper parts to interlock when said slider is moved in a first direction and to separate when said slider is moved in a second direction opposite to said first direction, wherein said terminus of said funnel portion and said slider in a zipper fully open position are located on opposite sides of said midplane of said package.

2. The package as recited in claim 1, wherein said terminus is closed.

3. The package as recited in claim 1, wherein said funnel portion, when in a not folded state inside said interior volume, has the shape of a scalene triangle.

4. The package as recited in claim 1, wherein said funnel portion and said receptacle are made of the same material.

5. The package as recited in claim 1, wherein said funnel portion and said receptacle are made of different materials.

* * * * *